United States Patent [19]

Gössler et al.

[11] Patent Number: 4,471,214

[45] Date of Patent: Sep. 11, 1984

[54] ELECTRICAL HEATING ELEMENT FOR HEATING A PLATE AND PROCESS FOR THE PRODUCTION THEREOF

[75] Inventors: Gerhard Gössler, Oberderdingen; Eugen Wilde, Knittingen; Bernhard Mikschl, Sulzfeld, all of Fed. Rep. of Germany

[73] Assignee: E.G.O. Elektro-Gerate Blanc und Fischer, Fed. Rep. of Germany

[21] Appl. No.: 398,556

[22] Filed: Jul. 15, 1982

[30] Foreign Application Priority Data

Jul. 24, 1981 [DE] Fed. Rep. of Germany ..... 3129239

[51] Int. Cl.[3] ..... H05B 3/68

[52] U.S. Cl. ..... 219/464; 219/457; 219/460; 219/463; 219/467; 338/301

[58] Field of Search ..... 219/345, 354, 438, 457, 219/458, 459, 460, 461, 462, 463, 464, 465, 467, 544, 532, 203, 522; 338/284, 280, 288, 290, 297, 299, 301, 316; 29/611

[56] References Cited

U.S. PATENT DOCUMENTS

| | | | |
|---|---|---|---|
| 1,831,889 | 11/1931 | Skutta | 219/462 X |
| 1,921,543 | 8/1933 | Schonfeld | 338/299 X |
| 3,316,390 | 4/1967 | Gaugler et al. | 219/464 |
| 3,567,906 | 3/1971 | Hurko | 219/464 |
| 3,612,828 | 10/1971 | Siegla | 219/464 |
| 3,833,793 | 9/1974 | McWilliams et al. | 219/464 |
| 4,243,874 | 1/1981 | Fischer | 219/467 |

FOREIGN PATENT DOCUMENTS

| | | | |
|---|---|---|---|
| 554482 | 7/1932 | Fed. Rep. of Germany . | |
| 891673 | 1/1972 | Canada. | |
| 2339768 | 2/1974 | Fed. Rep. of Germany . | |
| 2551137 | 5/1977 | Fed. Rep. of Germany . | |
| 2740163 | 9/1977 | Fed. Rep. of Germany . | |
| 2806367 | 2/1978 | Fed. Rep. of Germany . | |
| 7805391 | 6/1978 | Fed. Rep. of Germany . | |
| 2729929 | 8/1980 | Fed. Rep. of Germany . | |
| 480320 | 7/1916 | France | 219/467 |

*Primary Examiner*—Volodymyr Y. Mayewsky
*Attorney, Agent, or Firm*—Steele, Gould & Fried

[57] ABSTRACT

An electrical heating element (18) for heating a plate, e.g. a glass ceramic plate (14) has a multilayer insulating support (12) in whose dish-shaped depression heater coils (18) are arranged in spiral form. The heater coils are located on the insulating support surface (17) and have downwardly directed deformations (19) comprising a turn pressed out in the downwards direction. These deformations (19) are embedded in the surface layer (16) of the insulating support, which is mechanically stronger and more thermally conductive than the underlying insulating layer (15). The deformations are produced in a mould (22, 23) carrying the heater coils in slots (21) and by means of a bladelike punch (24) a turn is pressed into a depression (25). The connection between heater coil (18) and insulating support (12) during the moulding thereof comprises a loose insulating material, the heater coil and deformations being placed in slots (27) of mould part (26).

11 Claims, 9 Drawing Figures

Figure 2:
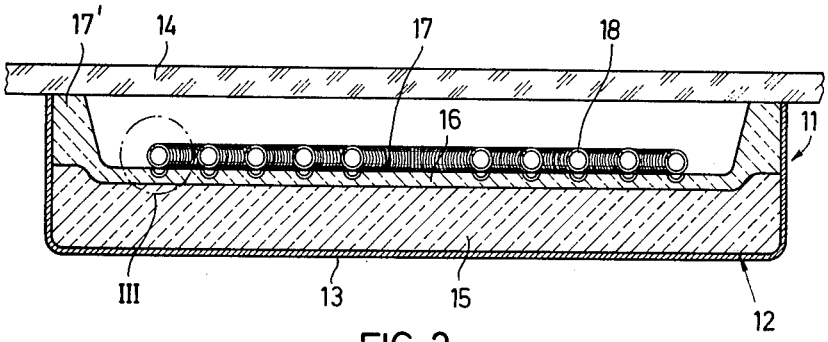

FIG. 1
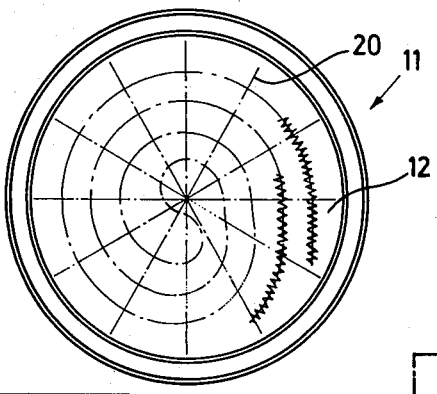
FIG. 7
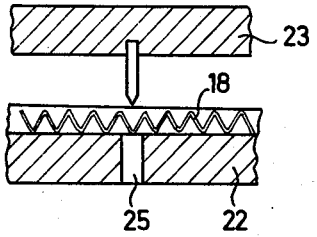
FIG. 6
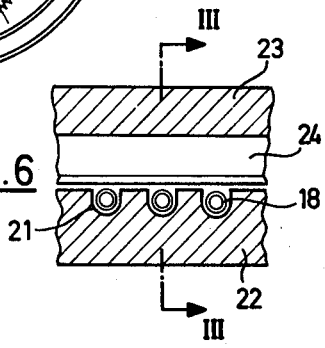
FIG. 8
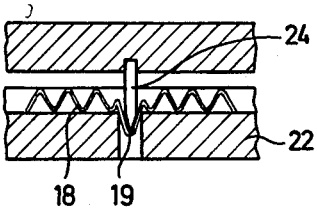
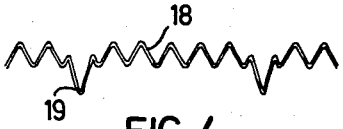
FIG. 4
FIG. 9
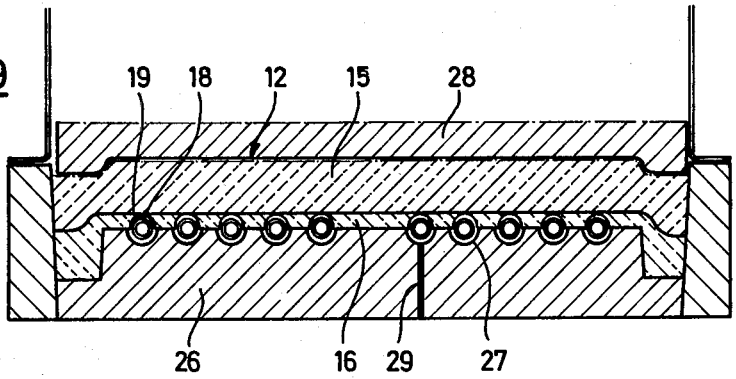

ELECTRICAL HEATING ELEMENT FOR HEATING A PLATE AND PROCESS FOR THE PRODUCTION THEREOF

The invention relates to an electrical heating element and to a process for the production thereof.

DAS Pat. No. 2,729,929 discloses an electrical heating element in which the heater coils are fixed in spiral manner on a plate-like insulating support in that they are spacedly embedded in radially directed projections or ribs on the surface of the plate-like insulating support. This construction has proved very satisfactory. However, this involves the insulating support being moulded prior to the fixing of the heater coils, so that several different operations are involved.

DOS Pat. No. 2,339,768 discloses an electrical heating element in which the heater coils are secured by pins bent in hairpin-like manner and which are subsequently embedded in insulating material. This fixing method is unreliable and is costly from the labour standpoint during manufacture.

U.S. Pat. No. 3,612,828 discloses a similar fixing for heating elements comprising sheet metal strips bent in corrugation-like manner. The U-shaped sheet metal or wire straps are placed through the insulating support and fixed with clips.

DOS Pat. No. 2,551,137 discloses a radiant heating element in which the heating conductor comprises a band punched and corrugated in meander-shaped manner and which has shaped-on projecting tongues, which are placed through a thin insulating support plate and are bent round and under the latter. The heating conductors made from bands are not only disadvantageous due to the punching process and the higher amount of waste than wire heater coils, but are also inferior from the durability standpoint.

The object of the invention is to provide an electrical heating element, which is easy to manufacture and in which the heater coils can be reliably fixed to the insulating support with a reduced risk of punctiform thermal overheating.

This object is achieved by the characterizing features of claim 1. The deformations preferably comprise an axially spaced, one-sided bend of the coil and in particular in each case only a single turn is pressed out of the remaining coil configuration. The resulting "feet" are axially spaced from one another and are pressed into the otherwise planar or unprofiled surface of the insulating support, whilst the remainder of the heater coil passes in a free, unembedded manner over the said surface. This means that during the subsequently described compression moulding process, although the heater coils can undergo a certain surface misshaping, so that they acquire a good lateral hold, it is to be ensured that the material of the insulating support extends over and envelopes the lower wire of the coil.

Particular preference is given to an embodiment in which the surface or surface layer carrying the heater coils is made mechanically stronger and more thermally conductive than the remainder of the insulating support, preferably by impregnation or curing. As a result of the mechanical strengthening, the holding or retaining action of the "foot" in the insulating support is improved and the insulating support is also made less sensitive for the purpose of transportation and assembly. The remaining insulating material can then be made from a material which is less mechanically strong and which can consequently have better thermal insulating properties. In addition, this rather denser surface layer means that the heat from the deformed, embedded part of the coil is better dissipated, so that there can be no accumulation of heat there, which could lead to the overheating and burning through of the wire.

For a simple large-scale manufacture of the electrical heating element, according to the preferred production process, the heater coil arranged with its fitting configuration in a mould can be zonally provided with deformations by preferably ledge or strip-like punches. The heater coil can then be placed in a compression mould part provided with mounting supports for the said coils in such a way that at least the deformations project beyond the surface of the mould part and the insulating material introduced in loose form, optionally in individual layers into the mould can be compacted, accompanied by the simultaneous moulding of the deformations. This moulding process can take place dry, so that there is no need for subsequent drying processes.

Following moulding, the surface or surface layer carrying the heater coils is preferably impregnated with a reinforcing material, preferably a silica sol. This leads to the aforementioned mechanically stronger and more thermally conductive surface layer. In order to limit the reinforcement area to the surface layer, preferably the surface layer to be impregnated is made from a hydrophilic insulating material and the underlying insulation is made from a comparatively hydrophobic insulating material. However, it is also possible to add a curable substance to the insulating material for the surface layer and which e.g. cures in heat. During the first trial heating operations, the heater coils can produce the heat which is used for curing purposes, making it possible to progressively increase curing in the vicinity of the heater coils.

Further advantages and features of the invention can be gathered from the subclaims and description in conjunction with the drawings. An embodiment of a heating element and a diagrammatic representation of the production process are represented in the drawings and are explained in detail.

In the drawings show:

FIG. 1 a diagrammatic plan view of an electrical heating element.

FIG. 2 a section through the heating element and part of a glass ceramic plate.

Figure 3:
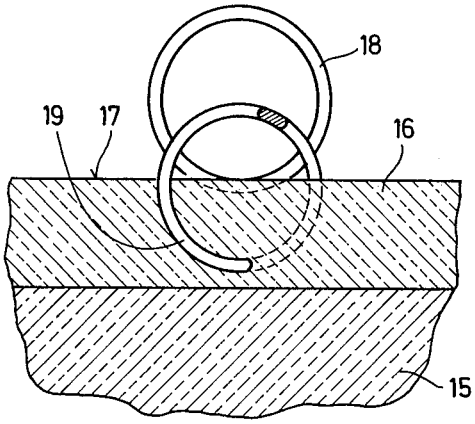

FIG. 3 a considerable enlargement of the section in circle III of FIG. 2.

FIG. 4 a side view of a heater coil.

Figure 5:
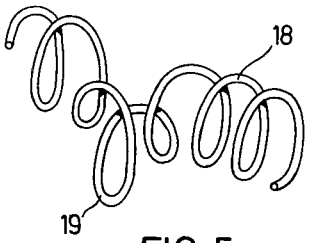

FIG. 5 a perspective view of part of the heater coil.

FIG. 6 a detail section through a mould for moulding the heater coil.

FIGS. 7 and 8 sections in the plane of line VII—VII of FIG. 6 in two different working stages.

FIG. 9 a section through a mould in which is moulded a heating element.

The electrical radiant heating element 11 shown in FIGS. 1 and 2 has an insulating support 12, arranged in a sheet metal support shell 13. The heating element is pressed by a spring (not shown) onto the underside of a glass ceramic plate 14. However, it can also be used for heating other surfaces, for example metal plates or individual hotplates.

The insulating support 12 comprises two layers, namely an insulating layer 15 made from a thermally stable insulating material with very good insulation characteristics and a surface layer 16 made from a heatproof insulating material, which is mechanically stronger and has somewhat better thermal conduction properties than insulating layer 15. This mechanically stronger material also forms the upright edge 17' of the insulating support, which is consequently better protected from damage.

A heater coil 18 is arranged on insulating support surface 17, which is set back with respect to edge 17' and consequently forms a shell-like recess. The coil is in the form of a double spiral (FIG. 1), so that both connections in the outer area are radially accessible.

Heater coils 18 are circular coils of round resistance wire having spaced deformations 19, as can be seen in FIGS. 3 to 5. It can be seen therefrom that a turn is pressed out to the side from the normal tubular or cylindrical course of the heater coil in such a way that it is in part outside the normal course of the coil. The two following turns are consequently somewhat compressed.

The deformations 19 are arranged in such a way that, in plan view on the heating element (FIG. 1), a radial pattern is obtained, in the manner indicated by the dot-dash lines 20. The deformations 19 are embedded in the insulating support material and specifically in surface layer 16, i.e. they are completely surrounded by the insulating material and are consequently held in the support in positively engaging manner. The other and in particular the undeformed turns of heater coil 18 are positioned substantially freely on the insulating support surface 17 where, in the manner shown in FIG. 3, they press somewhat into the surface, but are not completely surrounded by the insulating material, so that they can readily emit the heat formed therein.

Due to embedding, the heat cannot directly escape from deformed portion 19 or at least not from the lower part thereof. Part of the heat is dissipated via the resistance wire by thermal conduction. However, most of the heat is dissipated by thermal conduction from the surface layer 16. For this purpose, it is advantageous that the deformation of the heater coil is formed only by a single turn, because as a result the heat to be dissipated is very limited and can be well distributed. However, it would also be possible to deform and embed more turns in the case of less highly loaded coils.

FIGS. 6 to 8 show the production of the deformations of the heater coils. For this purpose, a heater coil conventionally produced by winding and subsequent "shrinking" to the correct length and pitch is placed in the slots 21 of a mould 22 having the double spiral shape shown in FIG. 1. A mould part 23 carries striplike dies 24, which are arranged in radial manner corresponding to lines 20 in FIG. 1. These strips 24 provided with a rounded cutting edge are positioned over corresponding depressions 25 in the lower mould part 22. After insertion (FIG. 7) the upper part 23 of the mould is lowered, so that the dies 24 penetrate between two turns of the heater coil and deform the same in the manner shown in FIGS. 3 to 5.

The thus prepared heater coil 18 with the deformations 19 pointing upwards is then placed in a lower mould part 26 and fixed in slots 27 in the spiral shape provided therein. Together with a movable mould upper part 28, the lower part forms a mould which corresponds to the finished insulating support. With the mould upper part 28 extended, insulating in the material in the form of a loose material is introduced into the cavity and initially takes up several times the volume of the subsequent insulating support. It is in fact introduced in the form of layers corresponding to the subsequently desired layer arrangement. The insulating material can, for example, be formed from the basic material pyrogenic silicic acid, such as is marketed by Degussa under the trade name Aerosil. It can also contain opacifiers for absorbing the infrared radiation such as e.g. titanium dioxide, iron oxide, carbon black or other heat-resistant pigments. It is also possible to use ceramic fibres, e.g. aluminosilicate fibres as reinforcing fibres. In particular, the lower layer in the mould which subsequently forms layer 16, can receive an addition of a hardener, e.g. high-melting fritted glasses permitting a curing of the surface layer on heating. Certain metal oxides can also be used as the hardener additive.

On closing the mould, the insulating support is compressed to its final shape and the deformations 19 are pressed into the insulating material and are embedded by the latter, i.e. enveloped or pressed round. The remaining surface of the spirals acts as a mould surface and during the moulding process has the advantage that it permits an easy venting of the mould on providing vents 29, e.g. at the bottom of slot 27. The insulating support is preferably produced in a single operation, in spite of its multilayer construction resulting from the introduction of several layers of different insulating materials. However, it is also possible to mould in a layer-like manner, if e.g. different layers with different thicknesses are to be moulded.

In the case of an insulating material with a hardener additive in the surface layer, production is now complete. It now merely has to undergo surface hardening by heat application, e.g. applied by the heater coils 18. The mechanically denser and more thermally conductive surface layer 16 can also be produced without any subsequent treatment through a corresponding composition of the insulating materials. However, it is particularly advantageous after removing the blank from the mould to treat the surface with a material which brings about the desired properties. For example, silicon dioxide in colloidal form can be uniformly sprayed into a silica sol. However, instead of this or in addition thereto there can be a planned treatment in the area surrounding the deformations 19 of heater coils 18 by arranging e.g. spraying nozzles at the corresponding fixing points. It is also possible to bring about the desired mechanical strength and improved heat dissipation in the fixing areas without significantly influencing the insulating characteristics of the insulating support.

In order to bring about a good distribution of the impregnating agent without it penetrating too deeply, the surface layer 16 should be hydrophilic, i.e. water-absorptive because the silica sol is normally suspended in water. However, the underlying insulating layer 26 should be hydrophobic, so that the material cannot penetrate insulating layer 15 and reduce the thermal insulation characteristics. The pyrogenic silicic acid is normally hydrophilic, whereas the hydrophobic properties of the insulating layer 15 are brought about by a silicone treatment, e.g. by adding silicone groups.

During moulding, particularly the joint moulding of different layers, an intimate connection is formed, so that these layers cannot separate from one another.

Heating elements, particularly radiant heating elements can be produced in a largely automatic manner according to the invention. The deformed heater coils can be provided with all the external feed lines and then the complete insulating support, including its fixing process, can be carried out in one operation. The layerwise sequence of different insulating mixtures permits a planned adaptation to the desired use. For example, the uppermost layer must have a high electrical insulation strength with good emitting powers. Such a layer then contains e.g. titanium dioxide as the opacifier, accompanied by the addition of $Al_2O_3$. The lower layers can then be planned for maximum thermal insulation, whilst at the same time aiming at a low price.

Particularly as a result of the surface reinforcement in the complete area not covered by the supporting member, the described heating element has the advantage that it is not sensitive to atmospheric humidity and has a very good electrical insulation resistance, even in the cold state. Apart from using the aforementioned mould, the heater coils can also be produced in programmed manner by winding a certain number of turns in the normal manner on a machine and then producing a turn displaced to one side or of larger size. Although one-sided deformation has the advantage that it can be extremely easily produced and best complies with the thermal and fixing requirements, it is also possible to produce the projection in the form of an all-round turn with a larger diameter or e.g. draw out the deformation to only one side, whilst leaving the remainder of the turn in the overall configuration of the coil, so that the deformed turn then has a kidney-shaped configuration. In the case of a programmed production of the heater coil, this could also be produced with the corresponding pitch, rendering superfluous the otherwise conventional distortion or shrinking of the spiral wound onto a block. The round coil cross-section shape can also be replaced by other shapes, e.g. an elliptical or flattened shape. The shaping from a round wire coil could e.g. take place in the same mould in which the deformation is produced.

We claim:

1. An electrical heating device, comprising:

an insulating support with at least a layer of moldable silicic acid insulating material having a plate-shaped surface; and, a helical heater coil fixed on the plate-shaped surface of the insulating support, the coil having a plurality of windings, deformed windings spaced along said plurality of windings being molded into the moldable layer of the insulating support and undeformed windings of the heater coil resting freely on the plate-shaped surface between the spaced deformed windings, the deformed windings being windings displaced from the heater coil and embedded in the moldable layer of the insulating supporting and portions of the windings being enclosed by the material of the moldable layer of the insulating support.

2. The heating device according to claim 1, wherein the deformations in each case comprise a single turn pressed out from the heater coil.

3. The heating device according to claim 1, wherein the heater coil is arranged in a spiral and the deformations are located substantially radially on the insulating support.

4. The heating device according to claim 1, wherein the insulating support comprises a plurality of molded together insulating layers.

5. The heating device according to claim 1, wherein the moldable layer of the insulating support carrying the heater coils is mechanically stronger and more thermally conductive than the remainder of the insulating support.

6. The heating device according to claim 5, wherein the insulating support is mechanically stronger in the vicinity of the molded in deformations.

7. The heating device according to claims 5 or 6, wherein the moldable layer of the insulating support carrying the heater coils is impregnated to improve mechanical strength and is made from a hydrophilic insulating material, and an underlying portion of the insulating support is made from a comparatively hydrophobic insulating material.

8. The heating device according to claims 5 or 6, wherein the moldable layer of the insulating support carrying the heater coils contains a heat-curable material at least in the vicinity of the embedded deformation of the heater coil.

9. The heating device according to claim 1, wherein the moldable layer of the insulating material carrying the deformed coils is impregnated with a reinforcing material after molding.

10. The heating device according to claim 1, wherein the insulating material is cured by heat from the heater coils.

11. The heating device according to claim 1, produced by a method comprising the steps of:

positioning the heater coil in a mold, the coil being provided therein with zonal deformations by strip-like punches;

placing the coil in a mold part having a surface with mounting supports for the coil such that portions of the deformed windings project beyond the surface of the mold into an unmolded layer of the moldable insulating material; and, compressibly molding the insulating material to simultaneously surround the projecting portions of the deformations and to form the plate-like surface of the insulating support.

* * * * *